United States Patent [19]

Kim et al.

[11] 4,384,939

[45] May 24, 1983

[54] GOLD RECOVERY SYSTEM

[75] Inventors: Jung T. Kim, Fanwood; Dennis R. Turner, Chatham Township, Morris County, both of N.J.

[73] Assignee: Bell Telephone Laboratories, Incorporated, Murray Hill, N.J.

[21] Appl. No.: 243,270

[22] Filed: Mar. 12, 1981

[51] Int. Cl.[3] ..... C25C 1/20

[52] U.S. Cl. ..... 204/110

[58] Field of Search ..... 204/109, 290 R, 290 F, 204/272, 110

[56] References Cited

U.S. PATENT DOCUMENTS

| | | | |
|---|---|---|---|
| 3,926,751 | 12/1975 | DeNora | 204/290 F |
| 4,039,422 | 8/1977 | Packer et al. | 204/272 |
| 4,097,347 | 6/1978 | Packer | 204/109 |
| 4,153,523 | 5/1979 | Koontz et al. | 204/129 |
| 4,230,538 | 10/1980 | Turner | 204/15 |

*Primary Examiner*—R. L. Andrews

*Attorney, Agent, or Firm*—Walter G. Nilsen

[57] ABSTRACT

A procedure is described for recovering gold from rinse water. The recovery procedure involves electrochemical removal of the gold from the rinse water and is particularly advantageous for removing gold in low concentrations from rinse water.

8 Claims, 1 Drawing Figure

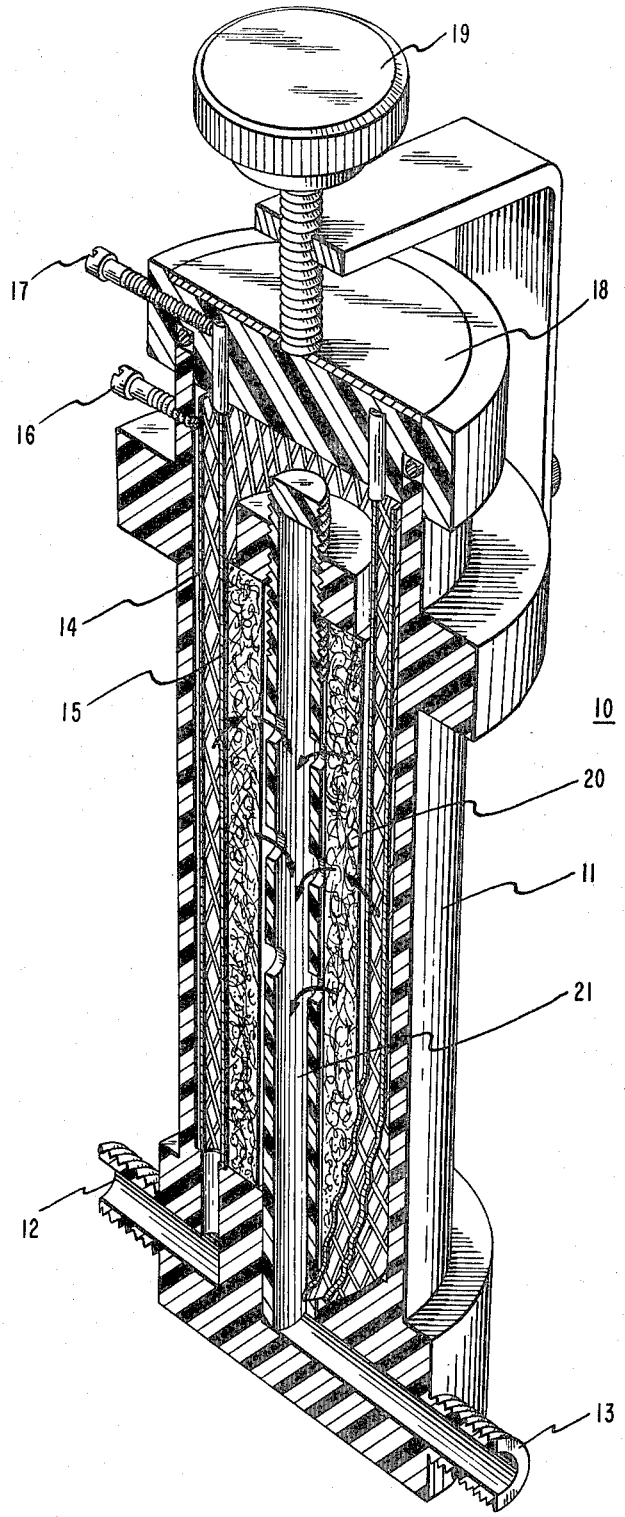
19
17
18
16
14
15
10
20
11
21
12
13

GOLD RECOVERY SYSTEM

TECHNICAL FIELD

The invention involves recovery of gold from aqueous solutions. The process is particularly useful for recovering gold from rinse water used in various processes involving gold such as gold plating processes.

BACKGROUND OF THE INVENTION

Gold plating processes have many industrial applications including production of jewelry and other decorative articles, production of optical devices and production of electronic circuits and components. There are several advantages to the use of gold. First of all, it does not form a surface insulating film such as an oxide film. For this reason, gold has a high surface luster which is quite attractive when used in jewelry articles. For the same reason, the optical reflection properties of gold are attractive, which makes its use in optical devices highly desirable. Again, for the same reason, its use in electric circuits and components is highly desirable because surface contact to gold usually has low electrical resistance.

Gold also has the advantage of being chemically inert. This is due to the fact that no surface insulating layer is formed on gold. The use of gold often increases the lifetime and reliability of devices and articles since gold is not affected by many chemicals and adverse conditions of temperature and humidity. A particular case in point is the production of integrated electronic circuits. Here quite thin and narrow conducting paths are required. Many metals (i.e., copper) might be satisfactory as far as electrical conductivity is concerned, but they rapidly degrade with time. Gold has the advantage of being inert, and also has quite high electrical conductivity.

Because of its excellent electrical contact properties, gold is often used in electrical connectors, switches and relays. By the addition of small amounts of various elements (for example, arsenic, cobalt, nickel), gold can be made quite hard and resistant to abrasion. For the above reasons, and because of the extensive growth of the integrated circuit industry, the industrial use of gold has increased tremendously in recent years. This fact, together with the high and increasing cost of gold has made it highly desirable to use gold in as efficient a manner as possible. In particular, it has become economically desirable to ensure that gold not actually plating onto a surface is recovered and not lost.

In many processes involving gold, such as gold plating processes, extensive use is made of rinse water to remove various reagents and prevent contamination of solutions used in subsequent steps in the process. Such rinsing operations are useful in all types of processes involving gold including, electroplating, electroless plating (displacement and autocatalytic plating), etc. Where gold plating solution is removed by the rinse water, significant amounts of gold are lost which adds to the cost of the plating process. It is highly desirable from an economic point of view to recover this gold. Also, from an ecological point of view, removal of gold from rinse water is desirable.

SUMMARY OF THE INVENTION

The invention is an electrochemical process for recovering gold from dilute aqueous solution using an electrolytic recovery cell. The unique parameters of the recovery process permits recovery of gold from highly dilute solutions, often less than 500 parts per million gold by weight. The recovery process is most advantageously used in conjunction with a continuous gold electroplating process where the gold is recovered from rinse water used to remove electroplating bath solution from plated parts. The structure and composition of the cathode is of special significance. A perforated structure is preferred so as to permit more rapid flow of the dilute aqueous solution past the cathode. Although a variety of metals may be used for the cathode, (copper, nickel, etc.) it is preferred that a metallic material be used which permits easy removal of gold without affecting the cathode material. Suitable metallic materials are titanium, tantalum, etc., with titanium preferred because of availability and relatively low cost. Alloys of titanium are useful provided they remain unaffected by procedures for removing gold but generally essentially pure titanium (greater than 98 weight percent titanium) is most preferred. A special design is used in the electrolytic recovery cell to ensure complete removal of gold from the rinse water even when the gold is present only in small concentrations. Typically the gold recovery removes gold down to a concentration of one part per million by weight. Such a recovery system prevents loss of gold washed off of plated parts and is economically highly advantageous because of the high cost of gold. Optionally, the gold may be reintroduced into a gold electroplating bath by exposing the plated gold on the titanium cathode to a cyanide electroplating bath.

BRIEF DESCRIPTION OF THE DRAWING

The FIGURE shows a perspective view (in section) of a plating cell useful in recovering gold from aqueous solution in accordance with the invention.

DETAILED DESCRIPTION

The invention is a process for recovering gold from dilute aqueous solution using an electrolytic recovery cell. The dilute aqueous solution is typically the rinse water in a gold electroplating process and typically has gold concentration in the range from 500 to one part per million by weight. More often, the concentration range is from 100 or even 10 to one parts per million. Higher concentrations are not usually encountered because the solution would no longer be an effective rinsing agent. Indeed, much lower concentrations are usually preferred so that the solution removed most of the gold from the part being rinsed. The lower concentration is approximately the limiting concentration that can be easily removed from the solution. A typical gold plating process where gold recovery is useful is described in U.S. Pat. No. 4,153,523 issued to D. E. Koontz and D. R. Turner on May 8, 1979 and U.S. Pat. No. 4,230,538 issued to D. R. Turner on Oct. 28, 1980.

In many applications involving gold, rinse water is recirculated and the gold (as well as other constituents) are allowed to accumulate. Before disposal, the gold is removed in accordance with the invention. In other processes, the gold is continuously removed and in some situations, the rinse water is disposed of continuously.

Although the gold recovery process is highly useful with a large variety of gold recovery processes, it is particularly convenient when used in conjunction with a gold strip line plating process like that described in the above two references. Such processes are often used to electroplate gold on high-volume items such as connector pins. In such a process, a strip travels down a succession of electrochemical processing containers (at least two cells but usually more) including cleaning, electrochemical polishing, electroplating, etc. Included in the strip line process are one or more gold electroplating sections, often one devoted to gold flash plating and another to hard gold electroplating. After the gold plating processes, the strip line is rinsed to remove residual gold plating solution. The rinse water is often recirculated and gold removed either periodically (as before disposal of the rinse water) or on a continuous basis.

In broad terms, the gold removal process involves flowing the dilute aqueous solution through a recovery cell made up of container (to hold the aqueous solution), anode and cathode. The physical arrangement of the anode and cathode are not critical and often depend on convenience. For example, the same container might serve another purpose such as filtering of the dilute aqueous solution or analysis of the dilute aqueous solution.

Certain design criteria increase the efficiency of the cell in removing the dissolved gold. First of all, high flow rates are preferred because it reduces the depletion layer thickness and increases the rate at which gold is removed from the dilute aqueous solution. It also increases the volume of solution exposed to the cathode per unit time and thereby increases the rate of removing gold from the dilute aqueous solution. For this reason, it is preferred that the flow rate be greater than three cm/sec, more preferred greater than 10 or even 20 cm/sec. Turbulent flow is also preferred so as to permit the more efficient removal of gold. Generally, it is preferred that the cathode (and often the anode) be of the flow-through type (sometimes called expanded metal construction) in which there are open holes or spaces in the electrode. Such a construction increases the velocity of flow and turbulence of the flow.

Large surface area for the cathode and anode are also preferred. This ensures more rapid and complete removal of the gold from the solution. Often, the cathode and anode are in the form of parallel, close-spaced surfaces such as parallel planes or concentric cylinders. The electrode potential is generally from 3 to 4 volts and the current is monitored to determine progress in the gold removal process. As gold is removed, the current (for a constant voltage) reduces and essentially complete removal of the gold is indicated by a constant current at constant voltage.

A large variety of materials can be used for anode and cathode. For the anode, traditional anode material usually used in electroplating operations may be used such as platinum, platinized titanium, etc. A particularly convenient anode structure is titanium coated with a mixture of iridium oxide and tantalum oxide. Typical compositions range from 10 to 90 mole percent iridium oxide, remainder tantalum oxide.

The cathode can be made of a variety of metallic materials. A particularly convenient material is titanium because of chemical stability and the ease with which gold electroplates on this material.

The use of titanium is advantageous when the gold recovery process includes redissolving the gold into the electroplating bath. The gold can be put back into the electroplating bath in a variety of ways. Particularly convenient is exposing the cathode structure with electroplated gold to the electroplating bath. Cyanide solution containing oxygen dissolves the gold attached to the cathode and converts it to the gold species (generally monovalent gold cyanide ion) used in the electroplating process. Titanium cathodes are advantageously used because they are inert chemically in such a process. Indeed, it is advantageously used in other redissolution processes such as dissolving the gold in Aqua Regia, electrochemical dissolution, etc.

A unique and highly convenient apparatus 10 for carrying out the recovery process is set forth in the FIGURE. This particular apparatus combines both the gold recovery function with a solution filtering function. The apparatus comprises a container 11 with entrance port 12 and exit port 13. Inside the container there is an anode 14 and cathode 15. These electrodes are in the form of perforated metallic cylinders with the cathode cylinder fitting inside the anode cylinder. Both cathode and anode have screw-type structures which permit electrical connection with the outside of the container. These structures are labeled 16 for the anode and 17 for the cathode. The container is fitted with a cover 18 with pressure screw 19 to ensure against leaks and proper alignment of cathode and anode. The incoming solution makes its way through the cathode and anode structure and into the filter assembly 20. After the solution goes through the filter assembly it goes into a manifold 21 and then through the exit port 13. Proper observation of the electrode current at constant voltage permits an estimate of the dilute solution composition.

What is claimed is:

1. A method for recovering gold from dilute aqueous solution used as rinse water in a continuous aqueous gold cyanide electroplating procedure comprising the step of passing current through an anode, the dilute aqueous solution and cathode in which the gold concentration in the dilute aqueous solution is less than 500 parts per million by weight, the flow rate of the dilute aqueous solution past the cathode is greater than 3 cm/sec, the cathode on which the gold is electroplated has a perforated structure, the anode and cathode are flow-through structures made up of concentric cylinders with one electrode inside the other, with the anode coated with a substance consisting essentially of 10 to 90 mole percent iridium oxide, remainder tantalum oxide and the cathode consists of at least 98 percent by weight titanium and the gold electroplated on the cathode is exposed to the aqueous gold cyanide electroplating bath so as to redissolve the gold in the gold electroplating solution.

2. The method of claim 1 in which the dilute aqueous solution has gold concentration less than 100 parts per million by weight.

3. The method of claim 2 in which the dilute aqueous solution has gold concentration less than 10 parts per million by weight.

4. The method of claim 1 in which the continuous gold electroplating process is a strip line plating process with at least two processing cells with a strip line moving between the two processing cells.

5. The process of claim 1 in which the gold is continuously removed from the dilute aqueous solution.

6. The process of claim 1 in which the gold is intermittently removed from the dilute aqueous solution.

7. The process of claim 1 in which the flow rate is greater than 10 cm/sec.

8. The process of claim 1 in which the cathode consists essentially of titanium.

* * * * *